US007111727B2

(12) United States Patent
Small et al.

(10) Patent No.: US 7,111,727 B2
(45) Date of Patent: Sep. 26, 2006

(54) ROLL HOLDING SYSTEM

(76) Inventors: David M. Small, 16223 S. 4th St, Phoenix, AZ (US) 85048; Yani Deros, 1027 E. Mountain Sage, Phoenix, AZ (US) 85048

( * ) Notice: Subject to any disclaimer, the term of this patent is extended or adjusted under 35 U.S.C. 154(b) by 198 days.

(21) Appl. No.: 10/757,101

(22) Filed: Jan. 13, 2004

(65) Prior Publication Data

US 2004/0144882 A1 Jul. 29, 2004

(51) Int. Cl.
*B65D 69/00* (2006.01)

(52) U.S. Cl. ..... 206/225; 206/394; 206/409

(58) Field of Classification Search ..... 206/389, 206/391, 393–395, 398, 409, 225, 233, 509, 206/511; 242/560, 590, 598.5, 598.6, 600, 242/601, 603

See application file for complete search history.

(56) References Cited

U.S. PATENT DOCUMENTS 2,564,539 A * 8/1951 Lucan ..... 242/560
3,930,697 A * 1/1976 Barouh et al. ..... 206/409
4,124,259 A * 11/1978 Harris ..... 242/598.6
4,177,958 A * 12/1979 Poole ..... 242/560
5,207,367 A * 5/1993 Dunn et al. ..... 206/409
5,954,256 A * 9/1999 Niada ..... 242/598.6
6,161,794 A * 12/2000 Cravatt ..... 242/598.6

* cited by examiner

*Primary Examiner*—Luan K. Bui
(74) *Attorney, Agent, or Firm*—Marian J. Furst

(57) ABSTRACT

A portable gift-wrap holding and dispensing system that can be used to store and dispense rolls of material. A cutting guide is provided to assist cutting the material.

22 Claims, 9 Drawing Sheets

ROLL HOLDING SYSTEM

CROSS-REFERENCE TO RELATED APPLICATION

The present application claims priority from and is related to applicant's prior U.S. Utility application Ser. No. 10/172,561, filed Jun. 13, 2002, abandoned, entitled "GIFT WRAP CUTTING AND HOLDING SYSTEM", the contents of which are herein incorporated by reference and are not admitted to be prior art with respect to the present invention by their mention in this cross-reference section.

BACKGROUND

This invention relates to providing a system for improved holding, measuring and cutting of paper, particularly gift wrapping paper of the type stored on hollow tubes.

Typically, gift-wrapping for holidays and other occasions is sold in rolls. Such rolls are typically about thirty-six inches (or less) in width with varying diameters of hollow, typically cardboard, tubes onto which such wrapping paper is most commonly rolled for dispensing. Consumers purchase such wrapping paper rolls and often have a plurality of such rolls on hand. Typically, these rolls of wrapping paper are stored on a shelf, closet floor or some other location. Oftentimes, it is difficult to find the rolls, or they are damaged while being stored. Furthermore, during dispensing of the wrapping paper, it is typically cumbersome to hold the paper, measure it, and then cut it (which is most often done with scissors). The paper has a tendency to move during cutting, thereby resulting in a crooked or torn edge on the paper.

OBJECTS AND FEATURES OF THE INVENTION

A primary object and feature of the present invention is to provide a system for an easily portable means to hold a plurality of wrapping paper rolls.

It is a further object and feature of the present invention to provide such a system which provides a means to carefully dispense the wrapping paper.

It is a further object and feature of the present invention to provide such a system which provides a means to accurately and cleanly cut the paper as desired (preferably without using sharp edges).

A further primary object and feature of the present invention is to provide such a system, which is efficient, inexpensive and handy. Other objects and features of this invention will become apparent with reference to the following descriptions.

SUMMARY OF THE INVENTION

In accordance with a preferred embodiment hereof, this invention provides a storage system, related to storing at least one roll of material and dispensing material from at least one selected such at least one roll of material, comprising: container means for containing the at least one roll of material; material dispensing means for dispensing material from the at least one selected roll of material; wherein such container means comprises storage holding means for removably holding the at least one roll of material, and dispensing holding means for removably holding the at least one selected roll adjacent such first material dispensing means; wherein such storage holding means and such dispensing holding means consist essentially of one unitary piece.

In accordance with another preferred embodiment hereof, this invention provides a storage system, related to storing at least one roll of material and dispensing material from at least one selected such at least one roll of material, comprising: at least one container to contain the at least one roll of material; at least one material dispenser to dispense material from the at least one selected roll of material; wherein such at least one container comprises at least one storage holder to removably hold the at least one roll of material, and at least one dispensing holder adapted to removably hold the at least one selected roll adjacent such at least one first material dispenser; wherein such at least one storage holder and such dispensing holder consist essentially of one unitary piece. Moreover, it provides such a storage system wherein such at least one storage holder and such at least one dispensing holder consist essentially of one unitary piece of molded plastic. Additionally, it provides such a storage system wherein such at least one container comprises at least one cover adapted to allow stacking at least one storage system on top of such at least one cover. Also, it provides such a storage system wherein such at least one container further comprises at least one separator to separate the at least one dispensing holder from the at least one storage holder. In addition, it provides such a storage system wherein such at least one material dispenser comprises at least one cutting guide to guide cutting dispensed material from the at least one selected roll. And, it provides such a storage system wherein such at least one storage holder further comprises at least one accessory holder adapted to hold at least one roll of ribbon. Further, it provides such a storage system wherein such at least one accessory holder comprises at least one ribbon dispenser to dispense ribbon from such at least one roll of ribbon, and such at least one ribbon dispenser comprises at least one slot through which ribbon may be dispensed while such at least one roll of ribbon remains within such at least one container. Even further, it provides such a storage system wherein such at least one material dispenser comprises at least one slot formed by at least one gap between such at least one storage holder and such at least one cover. Moreover, it provides such a storage system further comprising the at least one roll of material. Additionally, it provides such a storage system wherein such at least one cutting guide comprises at least one groove. Also, it provides such a storage system wherein such at least one storage holder, such at least one dispensing holder, and such at least one cutting guide consist essentially of one unitary piece. In addition, it provides such a storage system wherein such at least one storage holder, such at least one dispensing holder, and such at least one accessory holder consist essentially of one unitary piece. And, it provides such a storage system wherein such at least one roll of material comprise wrapping paper. Further, it provides such a storage system wherein such at least one material dispenser comprises at least one cutting guide to guide cutting dispensed material from the at least one selected roll. Even further, it provides such a storage system wherein such at least one storage holder further comprises at least one accessory holder adapted to hold at least one roll of ribbon. such at least one storage holder, such at least one dispensing holder, such at least one accessory holder, and such at least one cutting guide consist essentially of one unitary piece of molded plastic.

In accordance with a preferred embodiment hereof, this invention provides a portable system for gift-wrapping from at least two rolls of rolled paper and for unrolling the rolled paper and holding the unrolled paper comprising, in combination: at least two removable first holders each structured and arranged to removably hold at least one such roll of the rolled paper; at least one rotator structured and arranged to rotate such at least two removable first holders about a longitudinal axis; at least one lock structured and arranged to lock such at least one rotator; and at least one magnetic second holder structured and arranged to magnetically assist holding a length of the unrolled paper for cutting. It also provides such a system further comprising at least one measuring device structured and arranged to measure such length of the unrolled paper.

Further, it provides such a system wherein such at least one measuring device comprises a foldable ruler. And, it provides such a system further comprising at least one cutter structured and arranged to cut such length of the unrolled paper. And, it provides such a system further comprising at least one cutter structured and arranged to cut such length of the unrolled paper. Even further, it provides such a system wherein such at least one cutter comprises at least one filament; wherein such at least one filament is substantially comprised of a material selected from the group consisting essentially of: nylon; carbon fiber; and metal.

Still further, it provides such a system wherein each such removable first holder comprises: at least one rod; wherein such at least one rod comprises at least one retractable end. And, it provides such a system wherein such at least one rod comprises at least one substantially hollow rod; wherein such at least one substantially hollow rod comprises plastic. It also provides such a system wherein such at least one substantially hollow rod comprises PVC plastic pipe having a diameter no greater than about one inch.

Still further, it provides such a system wherein such at least one rotator further comprises: at least two ends situated substantially on the longitudinal axis of such rotator; and at least one rotatable handle structured and arranged to rotate such at least one rotator; wherein at least one of such at least two ends comprises a lock structured and arranged to hold such at least one rotator in a locked position. It also provides such a system wherein such at least one substantially hollow rod comprises at least six such substantially hollow rods. And, it provides such a system wherein such at least one magnetic second holder comprises: a first longitudinal bar comprising at least one magnet; and a second longitudinal bar comprising at least one magnetic attractor; wherein such first longitudinal bar and such second longitudinal bar are longitudinally aligned and structured and arranged such that such at least one magnet is aligned with such at least one magnetic attractor to provide a clamp for holding the paper when such first longitudinal bar and such second longitudinal bar are magnetically coupled. And, it provides such a system wherein such portable system is structured and arranged to be shipped in a knock-down state.

In accordance with a preferred embodiment hereof, this invention provides a portable system for gift-wrapping from at least two rolls of rolled paper, and for unrolling the rolled paper and holding the unrolled paper comprising, in combination: at least two removable first holders each structured and arranged to removably hold at least one such roll of the rolled paper; at least one rotator structured and arranged to rotate such at least two removable first holders about a longitudinal axis; at least one lock structured and arranged to lock such at least one rotator in a locked position; and at least one magnetic second holder structured and arranged to magnetically assist holding a length of the unrolled paper for cutting; at least one measuring device structured and arranged to measure such length of the unrolled paper; and at least one cutter structured and arranged to cut such length of the unrolled paper; wherein such at least one filament is substantially comprised of a material selected from the group consisting essentially of nylon, carbon fiber, and wire; wherein such at least two removable first holders each comprise at least one rod comprising at least one retractable end; wherein such at least one rotator further comprises at least two ends situated substantially on the longitudinal axis of such rotator, and at least one rotatable handle, structured and arranged to turn such at least one rotator, wherein such at least one rotator comprises a lock, structured and arranged to selectively hold such at least one rotator in a locked position; and wherein such at least one magnetic second holder comprises a first longitudinal bar comprising at least one magnet, and a second longitudinal bar comprising at least one magnetic attractor, wherein such first longitudinal bar and such second longitudinal bar are longitudinally aligned and placed such that such at least one magnet is aligned with such at least one magnetic attractor providing a clamp for holding the paper when such first longitudinal bar and such second longitudinal bar are magnetically coupled; and wherein a such roll of paper may be placed on a such first holder, rotated to a such locked position adjacent such cutter, unrolled over such cutter and between such first longitudinal bar and such second longitudinal bar, clamped by such at least one magnetic second holder and cut by such cutter. And, it provides such a system wherein such portable system is structured and arranged to be shipped in a knock-down state.

In accordance with another preferred embodiment hereof, this invention provides a portable system for holding rolled paper and for unrolling the rolled paper and holding the unrolled paper comprising, in combination: a base; six substantially hollow rods about thirty two inches in length, each such respective substantially hollow rod having at least one retractable end, and an outside diameter of about one-half inch, one rotator, attached to such base, comprising, such six substantially hollow rods, two ends situated substantially on a longitudinal axis of such one rotator, a central axle connecting such two ends, at least one rotatable handle, attached to such central axle to turn such one rotator, six slots on one of such two ends, each such slot corresponding to a selected position of such one rotator, and a releasable lock, having a tab, which fits each respective such six slots, to selectively hold such one rotator in a locked position when such tab is engaged in a respective such six slots; a magnetic holder, to magnetically assist holding a length of the unrolled paper for cutting, comprising a first longitudinal bar about thirty two inches in length adjustably attached to such base having five round magnets about one inch in diameter each, wherein each such five round magnets are located on such first longitudinal bar as follows: one first magnet about two inches from each respective end of such longitudinal bar, a second magnet about eight inches from each respective such first magnet; and a third magnet about centered between each such second magnet; and a second longitudinal bar, attached to such base, about thirty-two inches in length, comprising at least one magnetic attractor, wherein such first longitudinal bar and such second longitudinal bar are longitudinally aligned and placed such that such five round magnets are aligned with such at least one magnetic attractor, providing a clamp for holding the paper when such first longitudinal bar and such second longitudinal bar are magnetically coupled; at least one foldable ruler attached to such base to measure such length of the unrolled paper; and at least one nylon filament cutter adjacent such second longitudinal bar to cut such length of the unrolled paper; wherein a roll of paper may be placed on each such six substantially hollow rods, each such roll of paper may be rotated to a position adjacent such cutter, placed in such locked position, unrolled over such cutter and between such first longitudinal bar and such second longitudinal bar, clamped by such magnetic holder, and cut by such at least one nylon filament cutter. Additionally, it provides such a system wherein such portable system is structured and arranged to be shipped in a knock-down state.

In accordance with another preferred embodiment hereof, this invention provides a portable system for holding at least one roll of rolled paper and for unrolling a length of the rolled paper and holding the unrolled paper comprising, in combination: at least one first holder each structured and arranged to hold at least one such roll of the rolled paper; and at least one magnetic second holder structured and arranged to magnetically assist holding the length of the unrolled paper.

DETAILED DESCRIPTION OF PREFERRED EMBODIMENTS OF THE INVENTION

Figure 1:
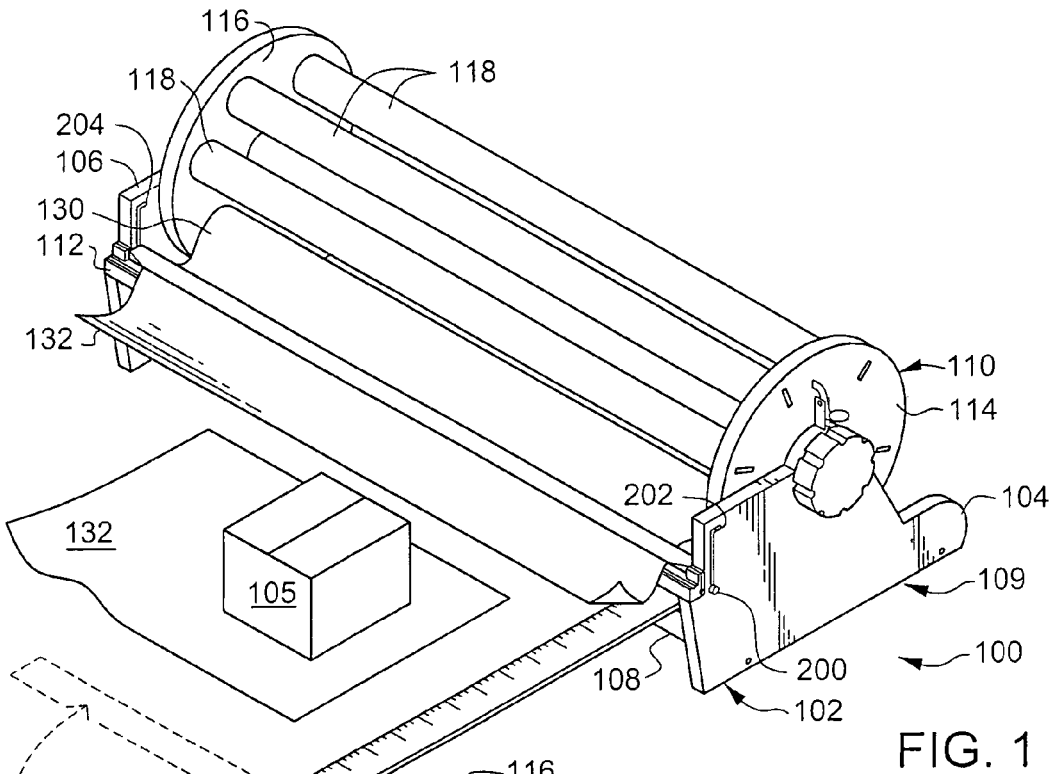
FIG. 1 is a perspective view of the gift-wrap cutting and holding system according to a preferred embodiment of the present invention.

FIG. 1 is a perspective view of the gift-wrap cutting and holding system 100 according to a preferred embodiment of the present invention.

Figure 2:
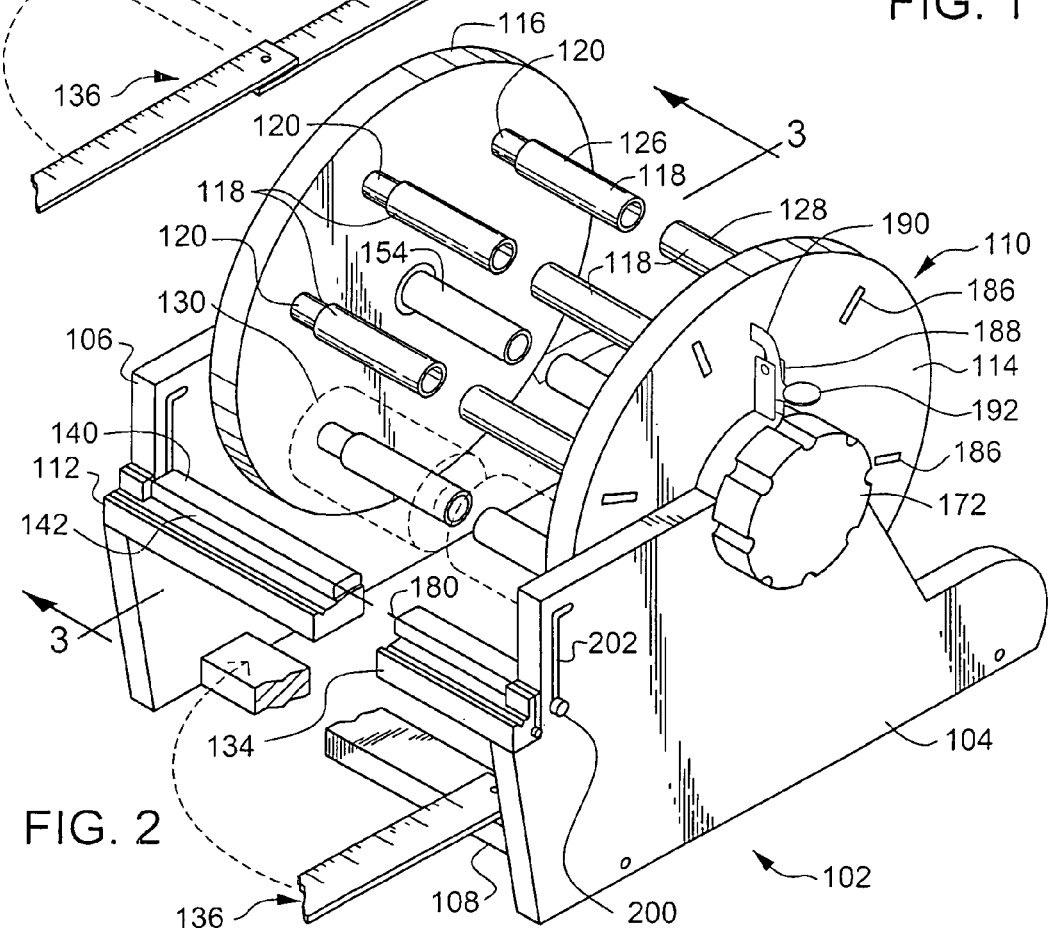
FIG. 2 is perspective view, partially in section, of the gift-wrap cutting and holding system according to a preferred embodiment of the present invention.

FIG. 2 is a perspective view, partially in section, of the gift-wrap cutting and holding system 100 according to a preferred embodiment of the present invention. Preferably, the gift-wrap cutting and holding system 100 comprises a portable gift-wrap cutter and holder 102, as shown. Preferably, the gift-wrap cutter and holder 102 comprise two side subassemblies 104 and 106, as shown. Preferably, the two side subassemblies 104 and 106 are connected by cross members 108, forming a base 109 (at least embodying herein a base), as shown. Preferably, the gift-wrap cutter and holder 102 further comprise a rotator 110 (at least embodying herein at least one rotator structured and arranged to rotate such at least two removable first holders about a longitudinal axis) and a cutting assembly 112 (at least embodying herein at least one cutter structured and arranged to cut such length of the unrolled paper), as shown. Preferably, the rotator comprises two ends 114 and 116 that are preferably mounted one to each respective side subassembly 104 and 106, as shown. Preferably, each respective end 114 and 116 is about nine inches in diameter, is preferably made of wood or plastic, and is preferably about one-half inch thick. Preferably, end 114 is attached to side subassembly 104, and end 116 is attached to side subassembly 106, as shown (this arrangement at least embodies herein wherein such at least one rotator further comprises at least two ends situated substantially on the longitudinal axis of such rotator). Upon reading the teachings of this specification, those with ordinary skill in the art will now understand that, under appropriate circumstances, considering issues such as advances in materials and technology, intended use, market demand, production cost, etc., other arrangements may suffice, such as, for example, alternate materials, alternate sizes and shapes, etc. Additional attachment details will be described below in reference to FIG. 4.

Preferably, the rotator 110 also comprises a plurality of removable rods 118, preferably six hollow rods, preferably plastic, preferably standard one-half inch internal diameter polyvinyl chloride (referred to hereafter as PVC) plastic rods, as shown (the above arrangement at least embodying herein at least two removable first holders each structured and arranged to removably hold at least one such roll of the rolled paper; and at least embodying herein wherein each such removable first holder comprises at least one rod, wherein such at least one rod comprises at least one retractable end, wherein such at least one rod comprises at least one substantially hollow rod, and, wherein such at least one substantially hollow rod comprises plastic). Preferably, each respective rod 118 is about thirty-two inches in length, and comprises a diameter less than the diameter of typically rolled gift wrapping rolls, or less than about one inch (at least embodying herein wherein such at least one substantially hollow rod comprises PVC plastic pipe having a diameter no greater than about than one inch), providing for holding a standard gift-wrapping paper roll of thirty and one-quarter inches in length. Most preferably, the PVC hollow rod is one-half inch PVC piping. Under appropriate circumstances, other materials and dimensions may suffice. Preferably, each respective rod 118 further comprises a retractable spring pin 120, as shown. Preferably, the retractable spring pin 120 functions such that grasping a respective rod 118 and applying pressure to the retractable spring pin 120 causes the retractable spring pin 120 to retract, thereby shortening the length of the rod 118 such that the end 122 of the rod 118 may be removed from the recess 124, which preferably holds the rod 118 in position on the respective ends 114 or 116 of the rotator 110, as shown (this arrangement embodies herein wherein such at least one rod comprises at least one retractable end). Further, the above described arrangement embodies six substantially hollow rods about thirty two inches in length, each such respective substantially hollow rod having at least one retractable end and an outside diameter of about one-half inch. Under appropriate circumstances, other arrangements may suffice. For example, a retractable spring pin 120 could be used on both ends 126 and 128 of the rod 118. Upon reading the teachings of this specification, those with ordinary skill in the art will now understand that, under appropriate circumstances, considering issues such as advances in materials and technology, intended use, market demand, production cost, etc., other rod arrangements may suffice, such as, for example, alternate materials (such as, for example, metal, wood, etc.), alternate sizes and shapes (such as, for example longer rods, larger diameter, etc.), more or fewer rods, rods without retractable ends, rods that aren't hollow, etc.

Preferably, cutting assembly 112 is attached to each of the side subassemblies 104 and 106, as shown. Preferably, the cutting assembly 112 is placed such that the rotator 110 may be positioned (and locked, as will be explained below) into place such that any respective rod 118 holding a single paper-roll 130 may be aligned such that the paper 132 will be approximately in line (parallel) with the preferably flat cutting surface 134 of the cutting assembly 112, as shown. Upon reading the teachings of this specification, those with ordinary skill in the art will now understand that, under appropriate circumstances, considering issues such as advances in materials and technology, intended use, market demand, production cost, etc., other cutting assembly arrangements may suffice, such as, for example, multiple cutting mechanisms could be provided, a rod 118 and respective paper-roll 130 could be placed on the rotator 110 so that multiple paper-rolls 130 could be used at a time, for example, an interior tissue paper and an exterior wrapping paper, etc. Even further, such paper 132 may be used, for example, to wrap a package 105, as shown.

Preferably, a cross-member 108 is placed directly below the cutting assembly 112, as shown. Preferably, such cross-member 108 comprises a measuring device 136, preferably an incremental ruler, preferably about a yard long or a meter long (depending on the preferred unit of measure), preferably foldable, as shown (this arrangement at least embodies herein at least one measuring device structured and arranged to measure such length of the unrolled paper, and wherein such at least one measuring device comprises a foldable ruler; and at least embodies herein at least one foldable ruler attached to such base to measure such length of the unrolled paper).

Preferably, the cutting assembly 112 further comprises a magnetic holder 140 (at least embodying herein at least one magnetic second holder structured and arranged to magnetically assist holding a length of the unrolled paper for cutting). Preferably, the magnetic holder 140 comprises a bar 142 (at least embodying herein wherein such at least one magnetic second holder comprises a first longitudinal bar comprising at least one magnet), preferably wooden, preferably about thirty-two inches in width, or as needed, to complete the dimension from side 104 to side 106. Preferably, the bar 142 comprises a plurality of magnets 144 (see FIG. 8), as shown. Preferably, the magnets are glued or otherwise permanently secured into the bar 142; however, under appropriate circumstances, other styles and formations of magnet arrangements may suffice. It is preferred to use five round magnets about one inch in diameter each, and with magnets placed as follows: one magnet about two inches from each respective end of the bar 142 nearest the sides 104 and 106; another magnet about eight inches from each respective first magnet; and a center magnet about centered in the bar 142. The above-described arrangement at least embodies herein a magnetic holder to magnetically assist holding a length of the unrolled paper for cutting, comprising a first longitudinal bar about thirty two inches in length adjustably attached to such base having five round magnets about one inch in diameter each, wherein each such five round magnets are located on such first longitudinal bar, as follows: one first magnet about two inches from each respective end of such longitudinal bar, a second magnet about eight inches from each respective such first magnet; and a third magnet about centered between each such second magnet. Upon reading the teachings of this specification, those with ordinary skill in the art will now understand that, under appropriate circumstances, considering issues such as advances in materials and technology, intended use, market demand, production cost, etc., other measuring device arrangements may suffice, such as, for example, use of a tape measure or other retractable measuring device, alternate dimensions, using a holder other than magnetic (such as, for example, a friction clip), omitting magnetic holder, etc.

Preferably, the flat cutting surface 134 of the cutting assembly 112 comprises magnetic attractors 146, preferably steel washers, preferably round, preferably about one inch in diameter. Preferably, the flat cutting surface 134 is about thirty-two inches in length to match up with the bar 142 (this arrangement embodies herein a second longitudinal bar, attached to such base, about thirty-two inches in length, comprising at least one magnetic attractor). Preferably, the magnetic attractors 146 are placed directly below the magnets 144 such that when bar 142 is lowered, the magnets 144 and magnetic attractors 146 are closely adjacent each other such that they are magnetically coupled and form a magnetic clamp (the above described arrangement embodies herein wherein such first longitudinal bar and such second longitudinal bar are longitudinally aligned and placed such that such five round magnets are aligned with such at least one magnetic attractor, providing a clamp for holding the paper when such first longitudinal bar and such second longitudinal bar are magnetically coupled). Under appropriate circumstances, other dimensions of the magnetic attractors, materials or placing arrangements may suffice. The illustrated arrangement is preferred for providing the preferred pressure against the paper 132 when the bar 142 is lowered against the flat cutting surface 134, when holding the paper 132 during cutting, as shown, for example, in FIG. 6.

Figure 3:
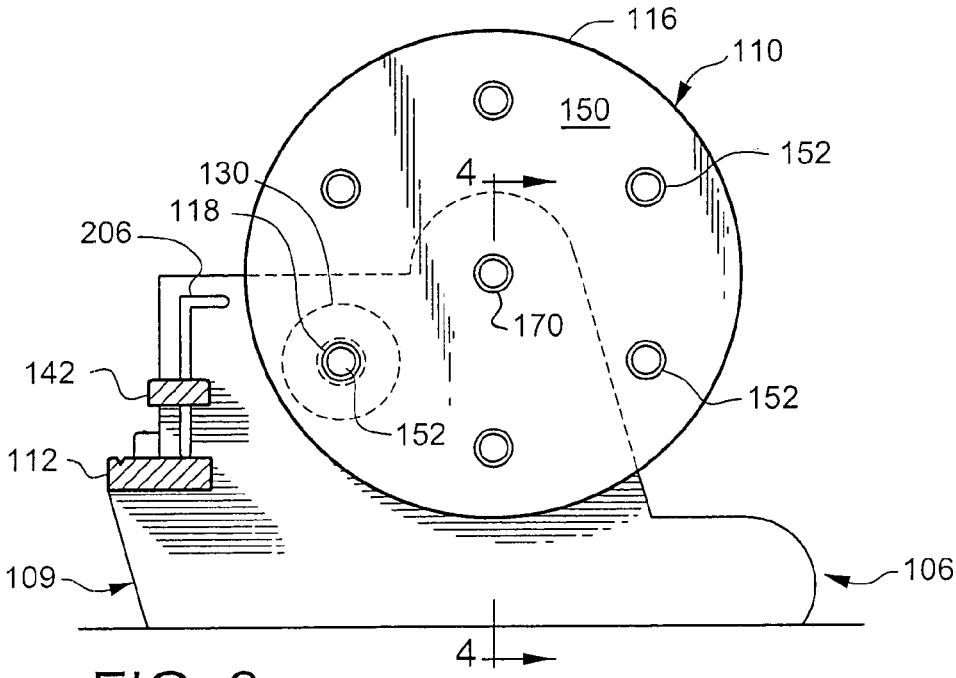
FIG. 3 is a sectional view through section 3—3 of FIG. 2.
Figure 4:
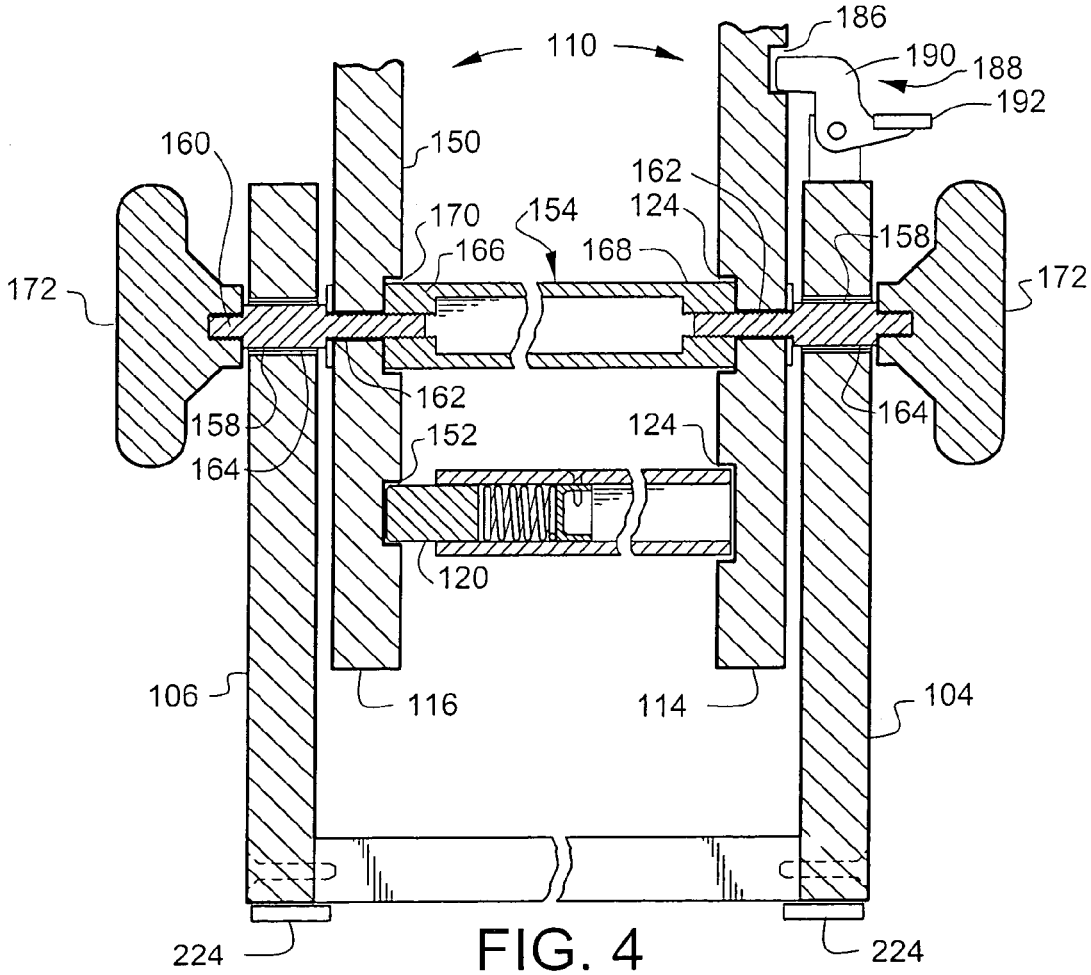
FIG. 4 is a sectional view through section 4—4 of FIG. 3.

FIG. 3 is a sectional view through section 3—3 of FIG. 2. FIG. 4 is a sectional view through section 4—4 of FIG. 3. FIG. 3 illustrates the inside face 150 of end 116. Preferably, the inside face 150 comprises six recesses 152, one for each respective rod 118, each recess 152 preferably sized to accommodate a retractable spring pin 120, as shown.

Preferably, rotator 110 comprises a central axle 154, preferably a wooden rod, preferably a one-inch diameter wooden rod. Preferably, each respective end 166 and 168 of axle 154 is attached to each respective end 114 and 116 of the rotator 110, as shown (at least embodying herein two ends situated substantially on a longitudinal axis of such one rotator, a central axle connecting such two ends). Upon reading the teachings of this specification, those with ordinary skill in the art will now understand that, under appropriate circumstances, considering issues such as advances in materials and technology, intended use, market demand, production cost, etc., other rotator arrangements may suffice, such as, for example, a larger axle, a metallic axle, plastic axle, multiple axles, etc.

FIG. 4 illustrates the preferred connection, as stated above.

Preferably, a bolt 160, preferably a shouldered bolt, preferably threaded on each end, as shown, with a smooth portion 158 situated in aperture 164, is threadably attached to each respective end 166 and 168 of the axle 154. Preferably, apertures 162 and 164 are drilled, as shown, in each end 114 and 116, and also in each side, 104 and 106, just large enough to allow bolt 160 to penetrate through each aperture 162 and 164, as shown. Preferably, a recess 170 is formed on face 150 such that the axle 154 may be placed in the recess 170 and be drawn tight to the recess 170 by tightening the bolt 160, thereby securing the axle 154 onto each respective end 114 and 116, as shown. Upon reading the teachings of this specification, those with ordinary skill in the art will now understand that, under appropriate circumstances, considering issues such as advances in materials and technology, intended use, market demand, production cost, etc., other attachment arrangements and materials may suffice.

Preferably, a handle 172 is threadably attached to each respective bolt 160, as shown. Preferably, each respective handle 172 may be used to rotate the axle 154, thereby rotating the rotator 110 (at least embodying herein at least one rotatable handle, attached to such central axle to turn such one rotator; and, at least one rotatable handle structured and arranged to rotate such at least one rotator). Under appropriate circumstances, other arrangements may suffice.

Preferably, cutting assembly 112 comprises a cutting element 180, as shown. Preferably, cutting assembly 112 also comprises a groove 182 which may be used to guide a cutting tool 178, such as a scissors (shown in FIG. 10) or razor blade when cutting the paper 132. Upon reading the teachings of this specification, those with ordinary skill in the art will now understand that, under appropriate circumstances, considering issues such as advances in materials and technology, intended use, market demand, production cost, etc., other cutting arrangements may suffice, such as, for example, multiple cutting grooves, etc.

Preferably, the portable gift-wrap cutter and holder 102 also comprise a locking means for locking the rotator 110 (this arrangement at least embodies herein at least one lock structured and arranged to lock such at least one rotator). Preferably, end 114 comprises a face 184, which comprises a plurality of stops 186, preferably grooves, as shown. Preferably, the grooves are situated such that when the locking mechanism 188 is applied and the rotator 110 is stopped, a rod 118 and associated paper roll 130 is in alignment with the cutting assembly 112, as previously described above (at least embodying herein six slots on one of such two ends, each such slot corresponding to a selected position of such one rotator; and, at least embodying herein wherein such at least one rotator comprises a lock, structured and arranged to selectively hold such at least one rotator in a locked position). Under appropriate circumstances, other arrangements may suffice. Preferably, the locking mechanism 188 is a spring-locking catch comprising a locking pin 190 and a release 192, preferably a finger-operated lever, as shown. Preferably, the rotator may be rotated by turning the handle 172, while holding down the release 192, until the desired paper roll 130 is aligned with the cutting assembly 112. Preferably, the release 192 is then released, and a spring returns the locking pin 190 toward the rotator 110 until the locking pin 190 is centered in the groove 186, thereby locking the rotator 110 from rotating (this arrangement embodies herein a releasable lock, having a tab, which fits each respective such six slots, to selectively hold such one rotator in a locked position when such tab is engaged in a respective such six slots). Under appropriate circumstances, other arrangements may suffice.

FIG. 4 also illustrates the preferred use of a non-slip bottom attachment 224. Preferably rubber, however, other non-slip materials may suffice.

Figure 5:
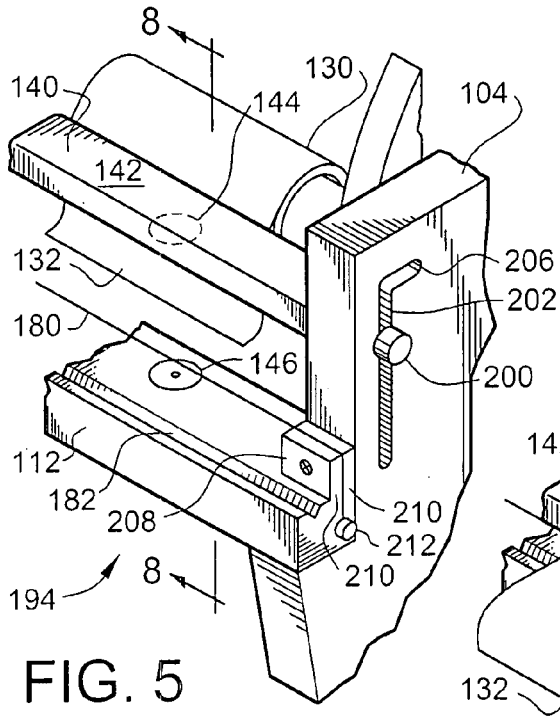
FIG. 5 is a perspective view, partially in section, illustrating a first position of the magnetic holder according to a preferred embodiment of the present invention.

FIG. 5 is a perspective view, partially in section, illustrating a first position 194 of the magnetic holder 140 according to a preferred embodiment of the present invention.

Figure 6:
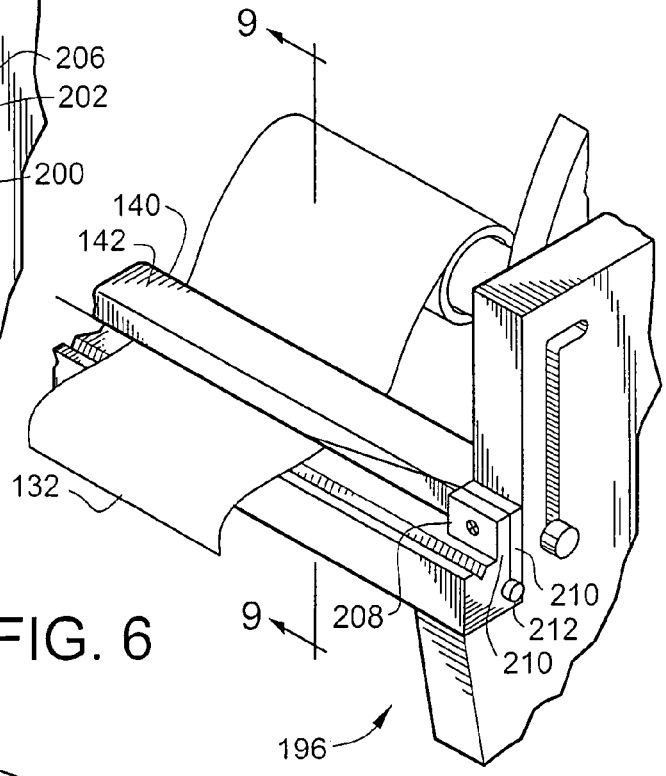
FIG. 6 is a perspective view, partially in section, illustrating a second position of the magnetic holder according to a preferred embodiment of the present invention.

FIG. 6 is a perspective view, partially in section, illustrating a second position 196 of the magnetic holder 140 according to a preferred embodiment of the present invention.

Figure 7:
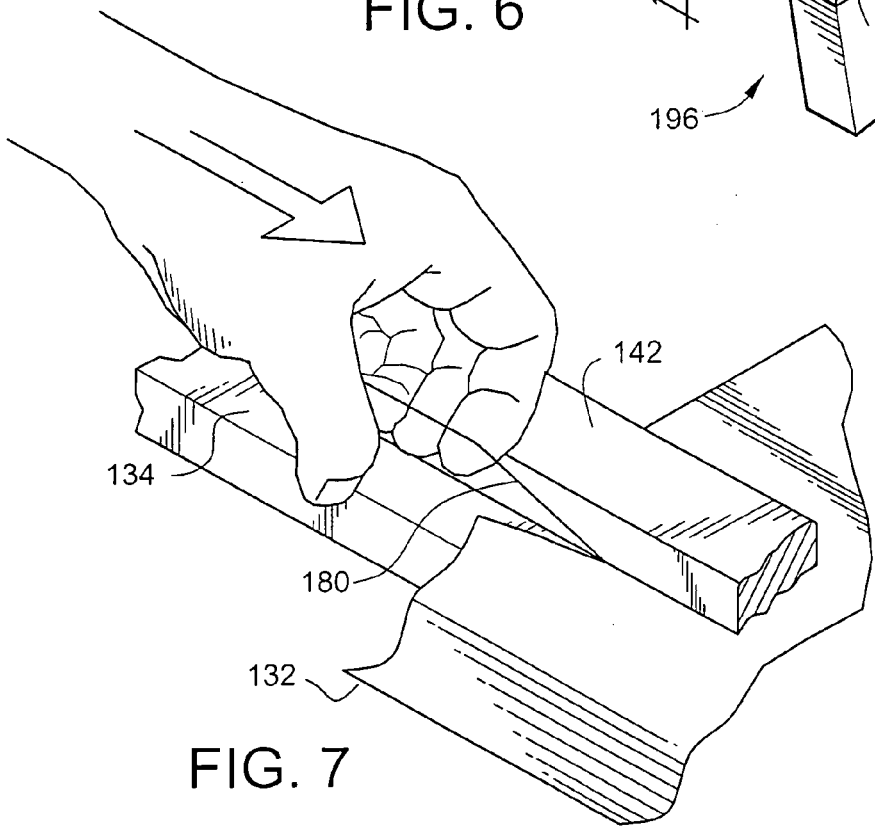
FIG. 7 is a perspective view, partially in section, illustrating a cutting element in use according to a preferred embodiment of the present invention.

FIG. 7 is a perspective view, partially in section, illustrating a cutting element 180 in use according to a preferred embodiment of the present invention.

Figure 8:
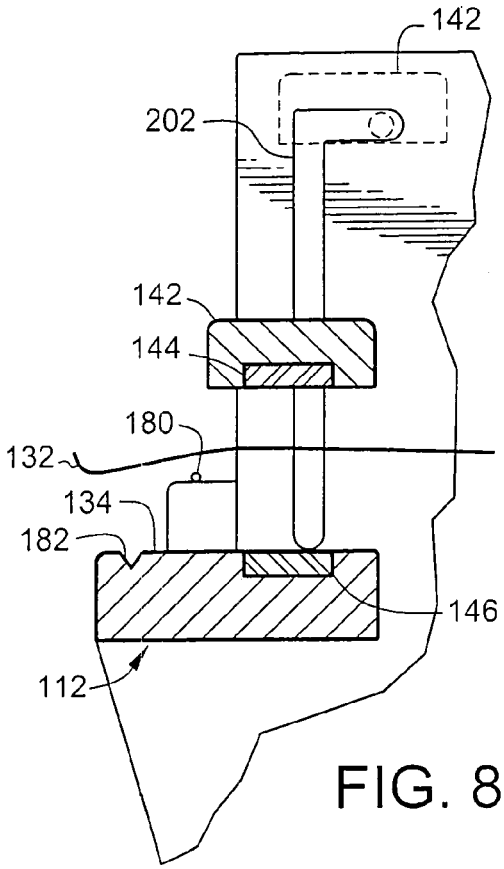
FIG. 8 is a sectional view through section 8—8 of FIG. 5.

FIG. 8 is a sectional view, through section 8—8, of FIG. 5.

Figure 9:
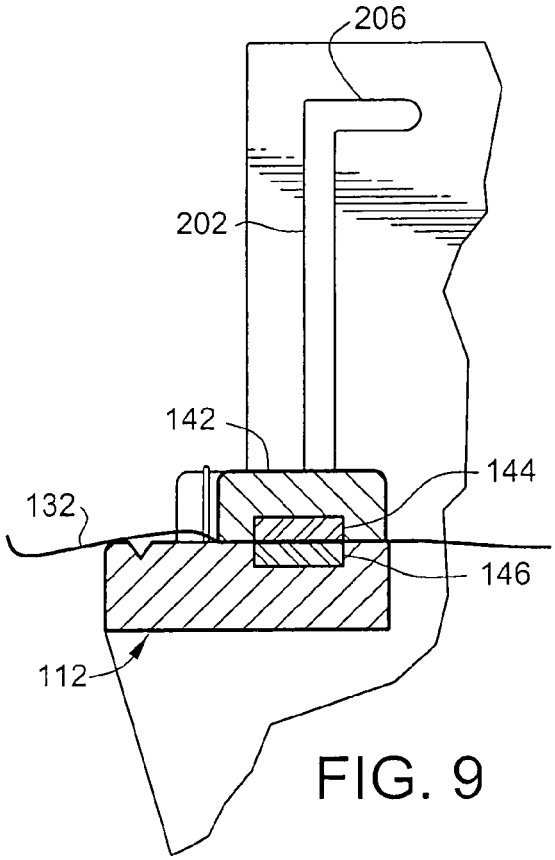
FIG. 9 is a sectional view through section 9—9 of FIG. 6.

FIG. 9 is a sectional view, through section 9—9, of FIG. 6.

Figure 10:
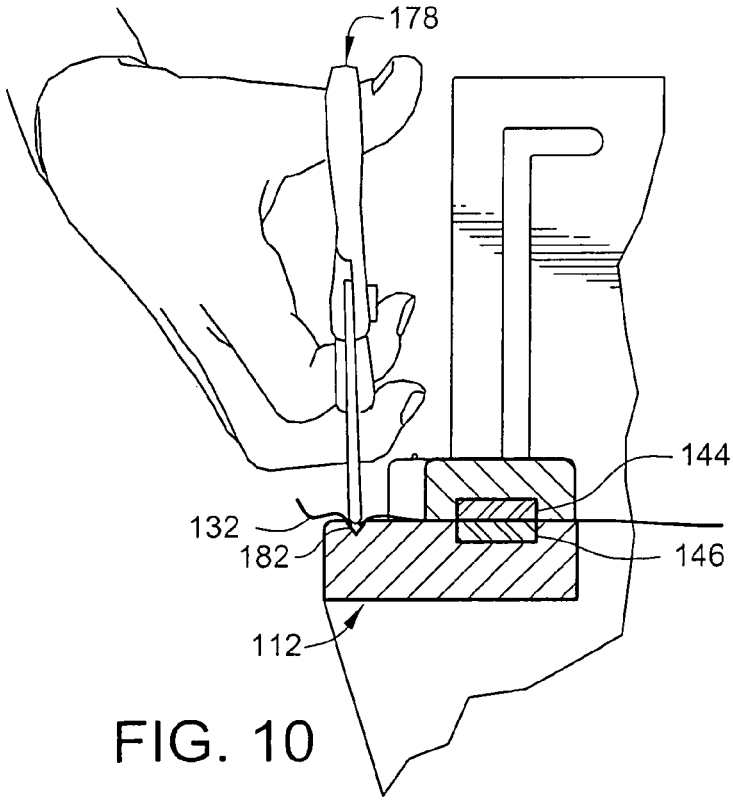
FIG. 10 is a sectional view through the section 9—9 of FIG. 6, illustrating an alternate embodiment of cutting the paper according to a preferred embodiment of the present invention.

FIG. 10 is a sectional view, through the section 9—9 of FIG. 6, illustrating an alternate embodiment of cutting the paper according to a preferred embodiment of the present invention.

The above FIGS. 5–10 illustrate a preferred method of utilizing the cutting assembly 112 and cutting the paper 130. Preferably, the magnetic holder 140 may be raised or lowered. Preferably, the magnetic holder 140 comprises pins 200, as shown. Preferably, there is a pin 200 on both ends of the magnetic holder 140. Preferably, the pin 200 is situated in a slot 202, preferably an upside down L-shaped slot, preferably inside 104, as shown. Preferably, there is a mirror image slot 204 on the opposite side 106, as shown. Under appropriate circumstances, other arrangements may suffice. Preferably, the magnetic holder 140 may be raised and held in a raised position by elevating the bar 142 such that the pins 200 can be moved into the upper position 206 of the slots 202 and 204, as shown.

Preferably, a user moves the bar 142 upward, as shown in embodiment 194, such that the magnets 144 are separated from the magnetic attractors 146 and create a space large enough to pull the paper 132 through the cutting assembly 112, as shown.

Preferably, a user may then pull a selected paper 132 from a paper roll 130 and pull the paper 132 over the cutting assembly 112. Preferably, the paper 132 is pulled under the cutting element 180, and along the flat cutting surface 134, as shown. Under appropriate circumstances, other arrangements may suffice.

Preferably, the bar 142 of the magnetic holder 140 is then lowered, as shown, into second position 196. Preferably, the magnets 144 provide a resistance against the paper 132 such that cutting element 180, most preferably, a nylon line such as that typically used in about a 20-pound test fishing line, may be pulled upward such that the paper is cut, as shown (at least embodying herein wherein such at least one cutter comprises at least one filament; and at least embodying herein at least one nylon filament cutter adjacent such second longitudinal bar to cut such length of the unrolled paper). The above-described arrangement at least embodies herein wherein a such roll of paper may be placed on a such first holder, rotated to a such locked position adjacent such cutter, unrolled over such cutter and between such first longitudinal bar and such second longitudinal bar, clamped by such at least one magnetic second holder and cut by such cutter. Under appropriate circumstances, other arrangements may suffice. For example, use of a metallic wire or carbon fiber material, or even natural gut may suffice (at least embodying herein wherein such at least one filament is substantially comprised of a material consisting essentially of nylon). FIG. 7 provides a preferred embodiment illustration of such action, as described above.

Preferably, the cutting element 180 is secured in place using a pair of holders 208, as shown. Preferably, holders 208 comprise split metal plates 210, which will allow the cutting element 180 to be placed between the plates 210, as shown. Preferably, the plates 210 are then tightened to hold the cutting element 180 utilizing a screw 210 which is threadably inserted in both plates 210 and tightened together. Under appropriate circumstances, other arrangements may suffice. Preferably, the cutting element 180 is also secured to a slotted key 212, structured and arranged to hold the cutting element 180, as shown. Under appropriate circumstances, other holding arrangements may suffice. Preferably, the cutting element 180 is provided as a safe way to cut the paper such that children or others using the (preferably nylon) string will not be injured.

It is noted that, although the gift-wrap cutting and holding system 100 is shown in a relatively horizontal position, the gift-wrap cutting and holding system 100 may be, under appropriate circumstances, placed in a vertical position. Preferably, the magnetic holder 140 would be adjusted to provide for vertical clamping.

Figure 11:
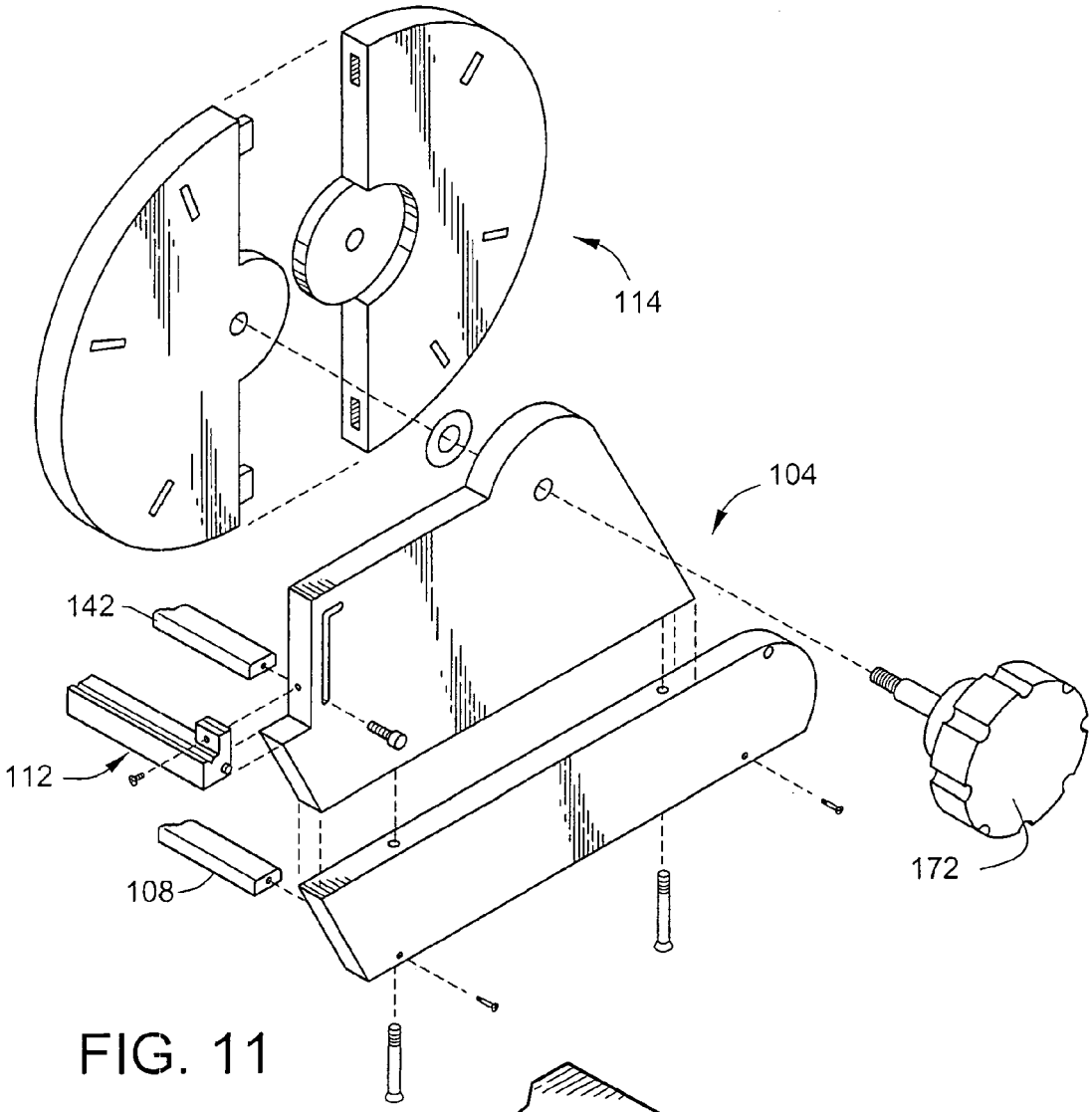
FIG. 11 is an exploded perspective view, partially in section, illustrating the assembly-disassembly of the gift-wrap cutting and holding system according to a preferred embodiment of the present invention.

FIG. 11 is an exploded perspective view, partially in section, illustrating the assembly-disassembly of the gift-wrap cutting and holding system 100 according to a preferred embodiment of the present invention. FIG. 11 illustrates a preferred assembly of the portable gift-wrap cutter and holder 102. Preferably, each respective one of the two side subassemblies 104 and 106, cross members 108, rotator 110, cutting assembly 112 and two ends 114 and 116 may be disassembled and shipped in a knock-down state such that the individual components will fit in a shipping container 220, as shown (at least embodying herein wherein such portable system is structured and arranged to be shipped in a knock-down state). Preferably, the shipping container 220 is rectangular, preferably recyclable cardboard, as shown. Under appropriate circumstances, other arrangements may suffice.

Figure 12:
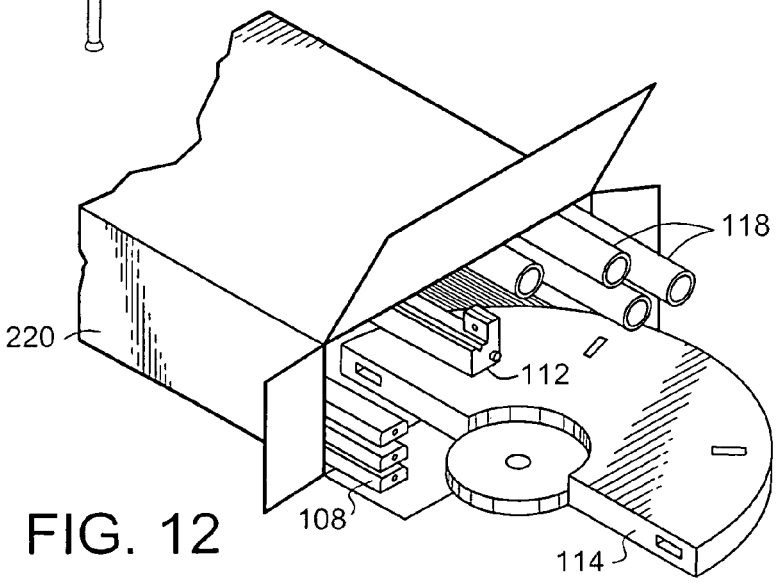
FIG. 12 is a perspective view, partially in section, illustrating the disassembled shipping of the gift-wrap cutting and holding system according to a preferred embodiment of the present invention.

FIG. 12 is a perspective view, partially in section, illustrating the disassembled shipping of the gift-wrap cutting and holding system 100 according to a preferred embodiment of the present invention.

It is noted, given the above-represented functions of the present invention, those knowledgeable in such art may recognize other ways to assemble/disassemble the components, under appropriate circumstances, without detracting from the scope of the present invention.

It is also noted that under appropriate circumstances, the magnetic holder holding arrangement may be applied to magnetically assist holding of rolled paper other than gift-wrap, and for a single roll or multiple-roll application.

Figure 13:
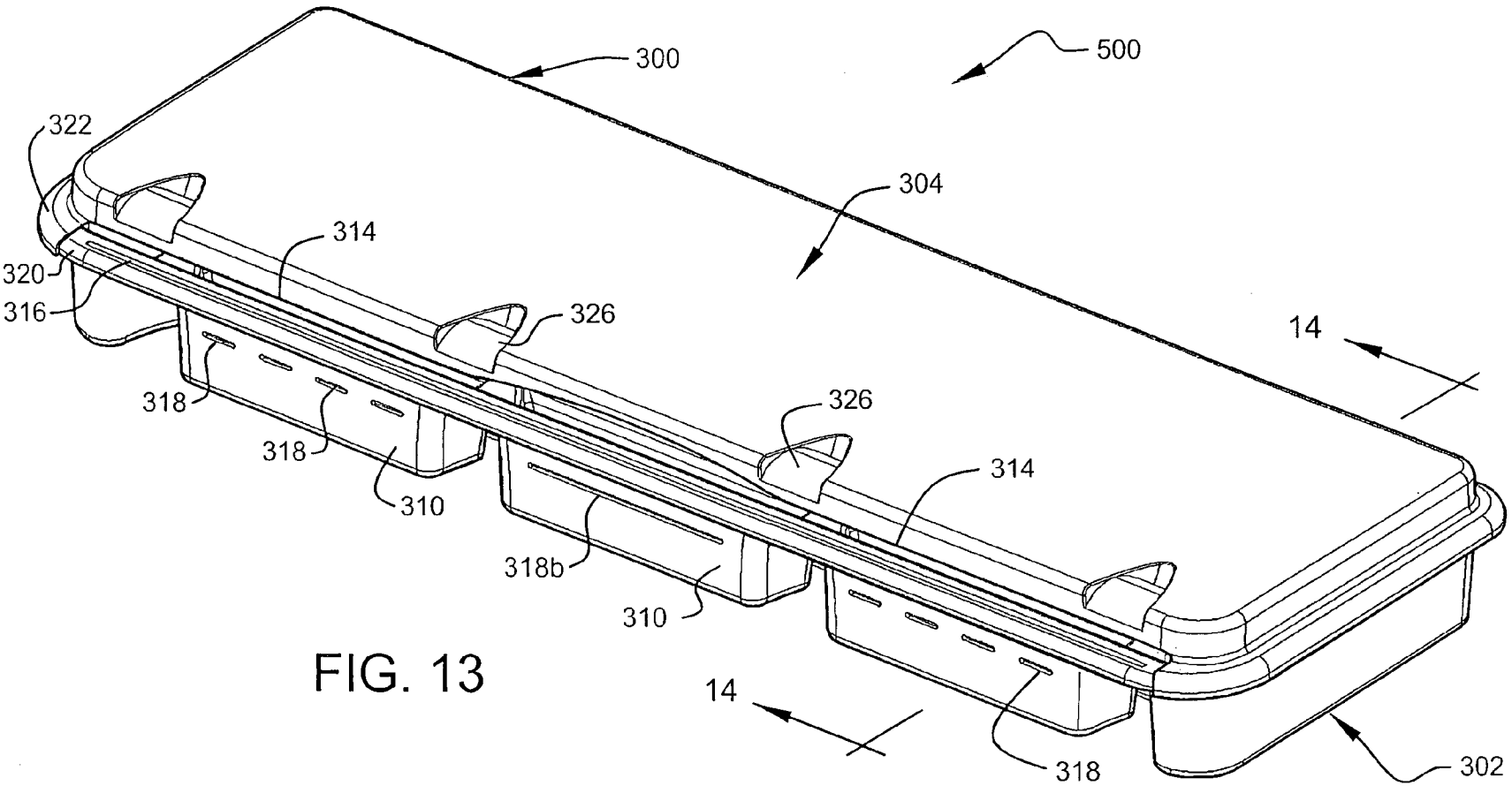
FIG. 13 is a perspective view of an alternate preferred embodiment of the present invention.

FIG. 13 is a perspective view of an alternate preferred embodiment of the present invention. Preferably storage system 500 comprises container 300. Preferably container 300 comprises bottom portion 302 and cover 304, as shown. Preferably container 300 is structured and arranged to enclose the contents of container 300, as shown. Preferably bottom portion 302 comprises container lip 320, as shown. Preferably cover 304 comprises cover lip 322, as shown. Preferably, cover lip 322 fits and removably snaps onto container lip 320, as shown. Preferably, container lip 320 extends around the entire perimeter of bottom portion 302, as shown. Preferably, cover lip 322 does not extend completely around perimeter of cover 304 (preferably cover lip 322 is absent where dispenser 314 is located), as shown. Upon reading the teachings of this specification, those with ordinary skill in the art will now understand that, under appropriate circumstances, considering issues such as intended use, market demand, production cost, etc., other cover arrangements may suffice, such as, for example, hinged covers, alternate attachment arrangements (such as, for example, omitting cover lip), etc.

Preferably container 304 comprises dispenser 314, as shown. Preferably dispenser 314 (at least embodying herein wherein said at least one material dispenser comprises at least one slot formed by at least one gap between said at least one storage holder and said at least one cover) comprises a gap between cover 304 and bottom portion 302, as shown. Upon reading the teachings of this specification, those with ordinary skill in the art will now understand that, under appropriate circumstances, considering issues such as intended use, production cost, etc., other dispenser arrangements may suffice, such as, for example, a slot in the side of bottom portion adjacent dispensing holder, etc.

Figure 14:
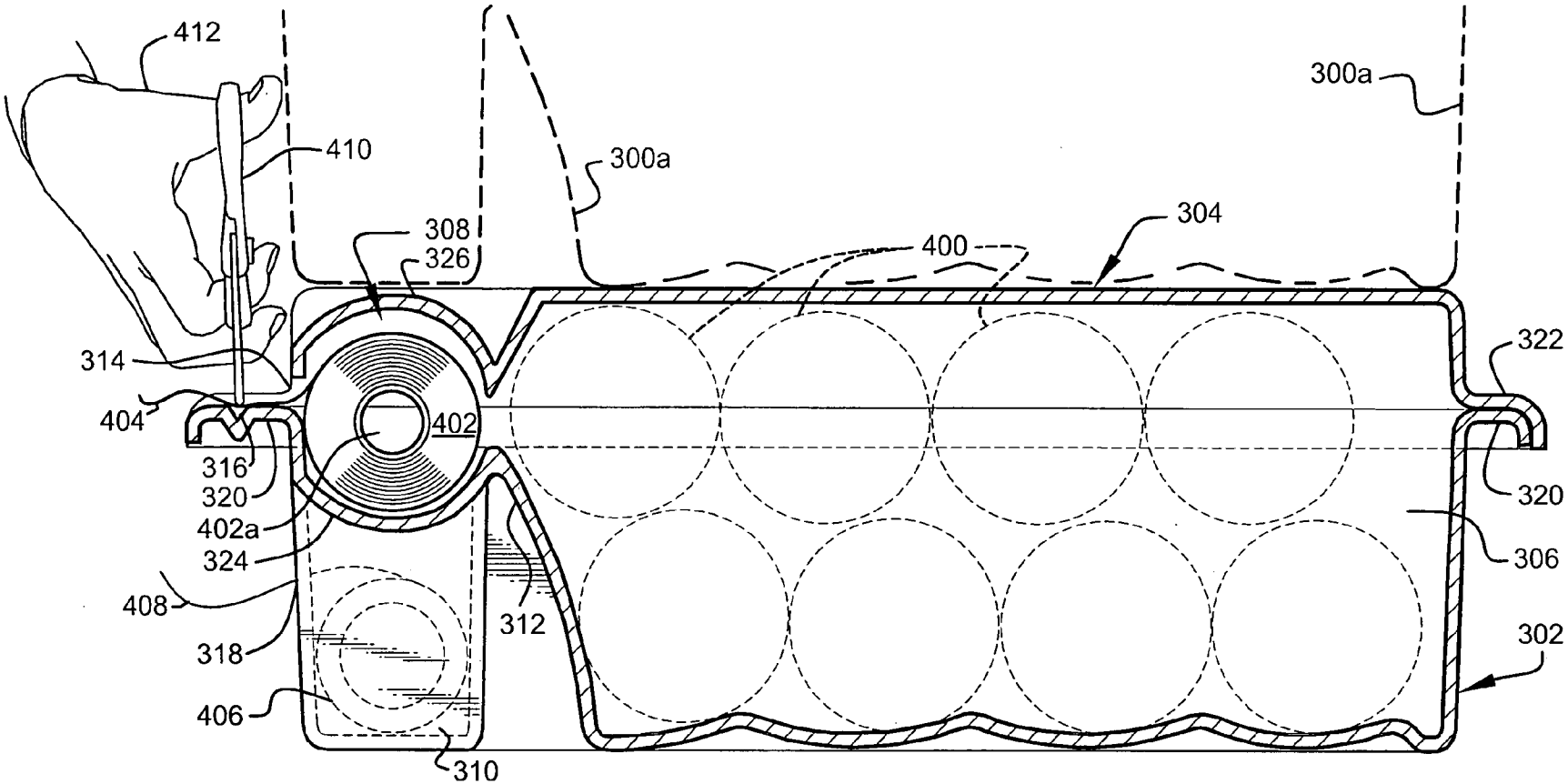
FIG. 14 is a is a sectional view through section 16—16 of FIG. 13 showing a user cutting material from a selected roll of material.

FIG. 14 is a sectional view through section 14—14 of FIG. 13 showing a user cutting material from a selected roll of material. Preferably, bottom portion 302 of container 300 (at least embodying herein container means for containing the at least one of material) comprises storage holder 306, as shown. Preferably, storage holder 306 (at least embodying herein storage holding means for removably holding the at least one roll of material) is adapted to hold a plurality of rolls of material 400, as shown. Preferably, container 300 comprises dispensing holder 308, as shown. Preferably, dispensing holder 308 comprises dispensing holder bottom 324 and dispensing holder top 326, as shown. Preferably dispensing holder 308 (at least embodying herein dispensing holding means for removably holding the at least one selected roll adjacent said first material dispensing means) is adapted to hold a selected roll of material 402 adjacent to dispenser 314 so that material 404 from selected roll of material 402 can be dispensed through dispenser 314 (at least embodying herein material dispensing means for dispensing material from the at least one selected roll of material), as shown. Preferably, dispensing holder bottom 324 and dispensing holder top 326 are formed to hold selected roll of material 402 in place and allow selected roll of material 402 to rotate (unravel) in place when a user 412 pulls on material 404 to dispense material 404 from selected roll of material 402.

Upon reading the teachings of this specification, those with ordinary skill in the art will now understand that, under appropriate circumstances, considering issues such as intended use, user preference, etc., other dispensing arrangements may suffice, such as, for example, a user may dispense material 404 from selected roll of material 402 without the need for cover (such as, for example, by lightly pressing on the top of selected roll of material 402 as it is dispensed to keep the selected roll of material 402 from accidentally being pulled out of container 300) etc.

Figure 15:
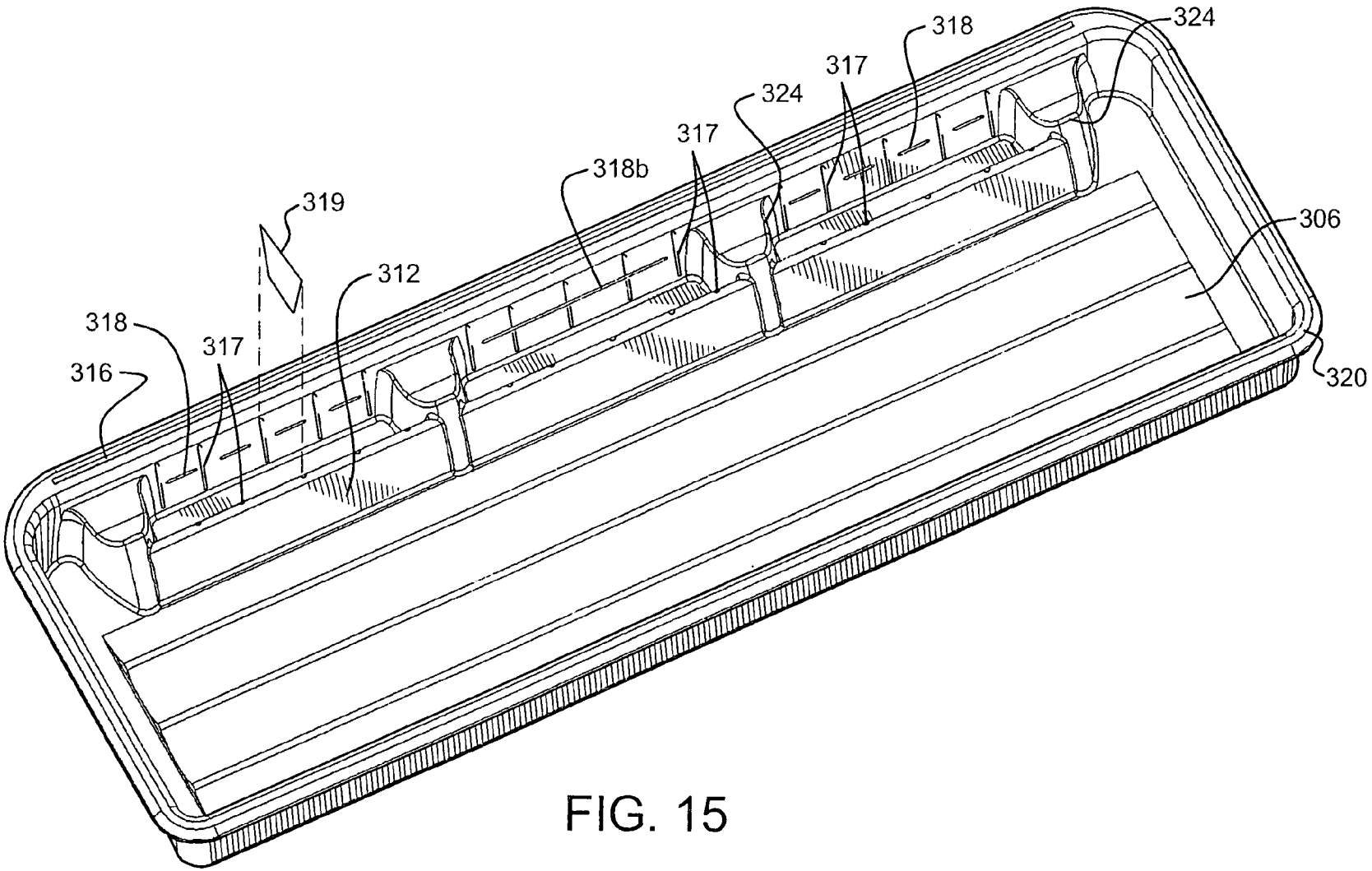
FIG. 15 is a perspective view of the embodiment of FIG. 13 showing the cover removed.

Preferably dispensing holder 308 cradles roll of material without the need for inserting anything (such as, for example, a dowel or axle, etc.) into the central aperture 402*a* of selected roll of material 402. Preferably, dispenser bottom 324 comprises a plurality of supports, spaced apart (as shown in FIG. 15). Preferably, holder top 326 comprises a plurality of guides spaced apart (as shown in FIG. 13). Upon reading the teachings of this specification, those with ordinary skill in the art will now understand that, under appropriate circumstances, considering issues such as intended use, production cost, etc., other dispensing holder arrangements may suffice, such as, for example, a dispenser holder that does not cradle roll of material, a dispenser holder that uses a dowel or pegs, one continuous support rather than a plurality of supports spaced apart, etc., inserted into the center of roll of material, etc.

Preferably, user 412 removes cover 304 (at least embodying herein wherein said at least one container comprises at least one cover adapted to allow stacking at least one storage system on top of said at least one cover), selects one of the rolls of material 400 from storage holder 306, places the selected roll of material 402 in dispensing holder 308, feeds some material 404 from selected roll of material 402 through dispenser 314 (at least embodying herein material dispensing means for dispensing material from the at least one selected roll of material) and then closes cover 304. Preferably, user 412 pulls the desired amount of material 404 from selected roll of material 402 through dispenser 314 and cuts material 404 using a cutting tool (preferably scissors) with the assistance of cutting guide 316, as shown. Upon reading the teachings of this specification, those with ordinary skill in the art will now understand that, under appropriate circumstances, considering issues such as intended use, user preference, safety, convenience, cost, etc., other cutting tool arrangements may suffice, such as, for example, using a cord, wire, etc. Preferably cutting guide 316 (at least embodying herein wherein said at least one cutting guide comprises at least one groove) comprises a groove in container lip 320, preferably cutting guide 316 is parallel to axis of rotation of selected roll of material 402, as shown. Preferably, cutting guide is adjacent dispenser 314 (at least embodying herein wherein said at least one dispenser comprises at least one cutting guide to guide cutting dispensed material from the at least one selected roll), as shown. Upon reading the teachings of this specification, those with ordinary skill in the art will now understand that, under appropriate circumstances, considering issues such as type of material, intended use, production cost, etc., other cutting guide arrangements may suffice, such as, for example, a built-in cutting tool (such as, for example, a slidable safety blade attached to dispenser), a built-in tearing tool (such as, for example, a serrated edge attached to dispenser), cutting guides other than a groove, etc.

Preferably, rolls of material 400 comprise rolls of wrapping paper, preferably rolls of gift-wrap. Upon reading the teachings of this specification, those with ordinary skill in the art will now understand that, under appropriate circumstances, considering issues such as intended use, production cost, etc., other types of rolls of material may suffice, such as, for example, rolls of paper other than gift-wrap, rolls of fabric, rolls of aluminum foil, rolls of plastic, etc. Preferably container 300 comprises at least one accessory holder 310, as shown. Preferably accessory holder 310 (at least embodying herein wherein said at least one storage holder further comprises at least one accessory holder adapted to hold at least one roll of ribbon) is adapted to hold at least one roll of ribbon 406. Preferably, accessory holder 310 is separated from storage holder by separator 312, as shown. Preferably, dispenser holder 308 is separated from storage holder by separator 312, as shown (at least embodying herein wherein said at least one container further comprises at least one separator to separate the at least one dispensing holder from the at least one storage holder). Upon reading the teachings of this specification, those with ordinary skill in the art will now understand that, under appropriate circumstances, considering issues such as intended use, production cost, etc., other types of accessory holder arrangements may suffice, such as, for example, accessory holders adapted to hold accessories other than ribbon (such as, for example, tape, bows, tools, scissors, twine, etc.), etc.

Preferably, at least one accessory holder 310 comprises at least one ribbon dispenser 318 (at least embodying herein wherein said at least one container comprises at least one material dispenser to dispense ribbon from such at least one roll of ribbon) for dispensing ribbon 408 from roll of ribbon 406, as shown. Preferably, at least one accessory holder 310 comprises at least one partition 319 which fits into partition slot 317 as shown. Preferably partitions 319 are removable, as shown, to create different sized accessory compartments and to accommodate different sized rolls of ribbon, etc. Preferably, partitions 319 assist in keeping rolls of ribbon oriented properly within accessory holder 310 so that ribbon may be easily dispensed. Preferably, ribbon dispenser 318 (at least embodying herein wherein said at least one ribbon dispenser comprises at least one slot through which ribbon may be dispensed while such at least one roll of ribbon remains within said container) comprises at least one slot (further illustrated in FIG. 15) through which ribbon may be dispensed from the interior of accessory holder 310 to the exterior of container 300, as shown. Preferably at least one accessory holder 310 comprises a wide ribbon dispenser 318*b* (also illustrated in FIG. 15). Preferably ribbon dispenser 318 is about one inch wide. Preferably wide ribbon dispenser 318*b* is about six inches wide. Preferably accessory holder 310 comprises a plurality of ribbon dispensers 318, so that each of a plurality of rolls of ribbon may have a dispenser 318 or large dispenser 318*b*. Upon reading the teachings of this specification, those with ordinary skill in the art will now understand that, under appropriate circumstances, considering issues such as intended use, production cost, etc., other types of ribbon dispensing arrangements may suffice, such as, for example, other types of dispensers, removing cover 304 to dispense ribbon (or other accessories), other shapes, sizes, and widths, etc.

Preferably cover 304 is adapted and shaped to facilitate stacking multiple containers 300 on top of each other, as shown. A typical stacking arrangement is illustrated by the additional container 300*a* (indicated with dashed lines) supported on cover 304 of container 300 (at least embodying herein wherein said at least one cover is adapted to permit stacking at least one storage system on top of said at least one cover), as shown.

FIG. 15 is a perspective view of bottom portion 302 without cover 304. Preferably, bottom portion 302 is one unitary piece, as shown (at least embodying herein wherein said storage holding means and said dispensing holding means consist essentially of one unitary piece, and at least embodying herein wherein said at least one storage holder, said at least one dispensing holder, and said at least one cutting guide consist essentially of one unitary piece, and at least embodying herein wherein said at least one storage holder, said at least one dispensing holder, and said at least one accessory holder consist essentially of one unitary piece). Preferably, container 300 is transparent so that users may quickly identify and assess the contents of container 300 without needing to open container 300. Preferably, bottom portion 302 is one unitary piece of molded plastic, as shown (at least embodying herein wherein said at least one storage holder and said at least one dispensing holder consist essentially of one unitary piece of molded plastic; and at least embodying herein wherein said at least one storage holder, said at least one dispensing holder, said at least one accessory holder, and said at least one cutting guide consist essentially of one unitary piece of molded plastic). Upon reading the teachings of this specification, those with ordinary skill in the art will now understand that, under appropriate circumstances, considering issues such as intended use, production cost, market demand, etc., other bottom portion arrangements may suffice, such as, for example, bottom portion may comprise more than one piece (such as, for example, bottom portion may be assembled from several pieces, accessory holder may comprise separate removable pieces, etc.), etc.

Figure 16:
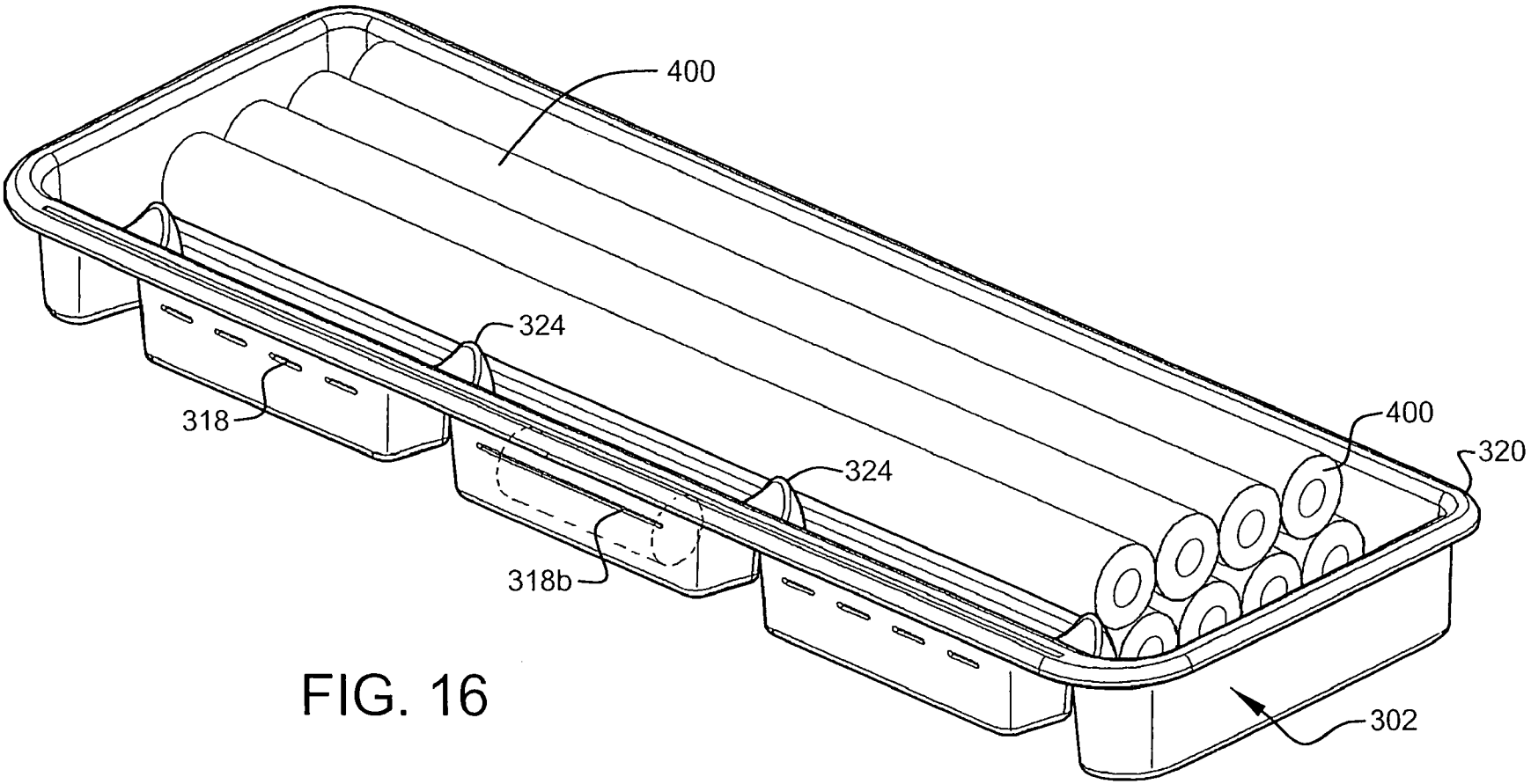
FIG. 16 is a perspective view of the embodiment of FIG. 13 showing the cover removed with rolls of material inside.

FIG. 16 is a perspective view of the embodiment of FIG. 13 showing the cover removed to reveal rolls of material inside. Preferably, container 300 is used to store a plurality of rolls of, gift-wrap. Preferably, each container 300 is about 40 inches wide to provide for holding typical gift-wrapping paper rolls up to about thirty-six inches in length. Preferably, each container 300 is about five inches tall to provide for holding multiple rows of standard gift-wrapping paper, as shown. Upon reading the teachings of this specification, those with ordinary skill in the art will now understand that, under appropriate circumstances, considering issues such as intended use, production cost, market demand, etc., other dimensional arrangements may suffice, such as, for example, the container may comprise shortened or extended lengths to contain other rolled material applications, or taller or shorter to respectively hold more or fewer rolls, etc.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A storage system, related to storing at least one roll of material and to dispensing material from at least one selected such at least one roll of material, comprising:

a) container means for containing the at least one roil of material;

b) material dispensing means for dispensing material from the at least one selected roll of material;

c) wherein said container means comprises i) storage holding means for removably holding the at least one roll of material, and ii) dispensing holding means for removably holding the at least one selected roll adjacent said material dispensing means;

d) wherein said storage holding means and said dispensing holding means consist essentially of one unitary piece;

e) wherein said dispensing holding means comprises cradling means for cradling the at least one selected roll adjacent said material dispensing means;

f) wherein said container means has a width greater than 20 inches.

2. A storage system, related to storing at least one roll of material and to dispensing material from at least one selected such at least one roll of material, comprising:

a) at least one container to contain the at least one roll of material;

b) at least one material dispenser to dispense material from the at least one selected roll of material;

c) wherein said at least one container comprises i) at least one storage holder to removably hold the at least one roll of material, and ii) at least one dispensing holder adapted to removably hold the at least one selected roll adjacent said at least one material dispenser;

d) wherein said at least one storage holder and said dispensing holder consist essentially of one unitary piece;

e) wherein said at least one dispensing holder comprises at least one cradle;

f) wherein said at least one cradle is structured and arranged to support the at least one selected roll adjacent said at least one material dispenser;

g) wherein said at least one container has a width greater than 20 inches.

3. The storage system according to claim 2 wherein said at least one storage holder and said at least one dispensing holder consist essentially of one monolithic piece of molded plastic.

4. The storage system according to claim 2 wherein said at least one container comprises at least one cover adapted to allow stacking at least one storage system on top of said at least one cover.

5. The storage system according to claim 2 wherein said at least one container further comprises at least one separator to separate the at least one dispensing holder from the at least one storage holder.

6. The storage system according to claim 2 wherein said at least one material dispenser comprises at least one cutting guide to guide cutting dispensed material from the at least one selected roll.

7. The storage system according to claim 2 wherein said at least one storage holder further comprises at least one accessory holder adapted to hold at least one roll of ribbon.

8. The storage system according to claim 2 wherein said at least one material dispenser comprises at least one slot formed by at least one gap between said at least one storage holder and at least one cover.

9. The storage system according to claim 2 further comprising the at least one roll of material.

10. The storage system according to claim 6 wherein said at least one storage holder, said at least one dispensing holder, and said at least one cutting guide consist essentially of one monolithic piece.

11. The storage system according to claim 7 wherein said at least one storage holder, said at least one dispensing holder, and said at least one accessory holder consist essentially of one unitary piece.

12. The storage system according to claim 9 wherein said at least one roll of material comprise wrapping paper.

13. The storage system according to claim 8 wherein said at least one material dispenser comprises at least one cutting guide to guide cutting dispensed material from the at least one selected roll.

14. The storage system according to claim 13 wherein a) said at least one storage holder further comprises at least one accessory holder adapted to hold at least one roll of ribbon.

b) said at least one storage holder, said at least one dispensing holder, said at least one accessory holder, and said at least one cutting guide consist essentially of one unitary piece of molded plastic.

15. The storage system according to claim 2 wherein said at least one cradle is structured and arranged to support the at least one selected roll adjacent said at least one material dispenser without inserting anything into the at least one selected roll.

16. The storage system according to claim 2 wherein said at least one cradle is structured and arranged to cradle the at least one selected roll peripherally rather than axially.

17. The storage system according to claim 2 wherein said at least one storage holder and said at least one dispensing holder are substantially translucent.

18. The storage system according to claim 2 wherein a) said storage system consists essentially of two pieces;

b) wherein said two pieces consist essentially of a monolithic bottom portion piece and a monolithic cover piece.

19. The storage system according to claim 2 wherein said at least one container has a width greater than 25 inches.

20. The storage system according to claim 2 wherein said at least one container has a width between about 32 inches and about 50 inches.

21. A storage system, related to storing at least one roll of material and to dispensing material from at least one selected such at least one roll of material, comprising:

a) at least one container to contain the at least one roll of material;

b) at least one material dispenser to dispense material from the at least one selected roll of material;

c) wherein said at least one container comprises i) at least one storage holder to removably hold the at least one roll of material, and ii) at least one dispensing holder adapted to removably bold the at least one selected roll adjacent said at least one material dispenser;

d) wherein said at least one storage holder and said dispensing holder consist essentially of one unitary piece;

e) wherein said at least one storage holder further comprises at least one accessory holder adapted to hold at least one roll of ribbon;

f) wherein said at least one accessory holder comprises at least one ribbon dispenser to dispense ribbon from such at least one roll of ribbon, and g) wherein said at least one ribbon dispenser comprises at least one slot through which ribbon may be dispensed while such at least one roll of ribbon remains within said at least one container.

22. A storage system, related to storing at least one roll of material and to dispensing material from at least one selected least one roll of material comprising:

a) at least one container to contain the at least one roll of material;

b) at least one material dispenser to dispense material from the at least one selected roll of material;

c) wherein said at least one container comprises i) at least one storage holder to removably hold the at least one roll of material, and ii)at least one dispensing holder adapted to removably hold the at least one selected roll adjacent said at least one material dispenser;

d) wherein said at least one storage holder and said dispensing holder consist essentially of one unitary piece;

e) wherein said at least one material dispenser comprises at least one cutting guide to guide cutting dispensed material from the at least one selected roll;

f) wherein said at least one cutting guide comprises at least one groove.

* * * * *